US007191910B2

(12) United States Patent
Deemer et al.

(10) Patent No.: US 7,191,910 B2
(45) Date of Patent: Mar. 20, 2007

(54) HOT FILLABLE CONTAINER

(75) Inventors: David A. Deemer, Adrian, MI (US); Hassan Mourad, Canton, MI (US)

(73) Assignee: Amcor Limited, Abbotsford (AU)

( * ) Notice: Subject to any disclaimer, the term of this patent is extended or adjusted under 35 U.S.C. 154(b) by 166 days.

(21) Appl. No.: 10/727,029

(22) Filed: Dec. 3, 2003

(65) Prior Publication Data

US 2005/0121408 A1 Jun. 9, 2005

(51) Int. Cl.
*B65D 1/40* (2006.01)
*B65D 23/10* (2006.01)

(52) U.S. Cl. ..... 215/381; 215/384; 220/666; 220/669; 220/695

(58) Field of Classification Search ..... 215/379, 215/381, 383, 384, 382; 220/666, 675, 669
See application file for complete search history.

(56) References Cited

U.S. PATENT DOCUMENTS 1,636,174 A * 7/1927 Dolan et al. ..... 215/384
3,325,031 A * 6/1967 Singier ..... 215/247
5,067,622 A * 11/1991 Garver et al. ..... 215/381
5,092,474 A * 3/1992 Leigner ..... 215/381
5,222,615 A * 6/1993 Ota et al. ..... 215/375
5,303,834 A * 4/1994 Krishnakumar et al. .... 215/381
5,971,184 A * 10/1999 Krishnakumar et al. .... 215/384
6,036,037 A * 3/2000 Scheffer et al. ..... 215/381
6,044,997 A * 4/2000 Ogg ..... 215/381
D423,935 S * 5/2000 Frazer ..... D9/520
D440,157 S * 4/2001 Lichtman et al. ..... D9/539
6,513,669 B2 * 2/2003 Ozawa et al. ..... 215/381
6,554,146 B1 * 4/2003 DeGroff et al. ..... 215/381
6,585,125 B1 * 7/2003 Peek ..... 215/381
D497,545 S * 10/2004 Knight et al. ..... D9/550
2002/0008077 A1 * 1/2002 Lane et al. ..... 215/381
2002/0020687 A1 * 2/2002 Sasaki et al. ..... 215/384
2003/0168425 A1 * 9/2003 Yourist ..... 215/381
2004/0026357 A1 * 2/2004 Beck et al. ..... 215/384

FOREIGN PATENT DOCUMENTS

JP 565158 A * 3/1993 ..... 220/675

* cited by examiner

*Primary Examiner*—Sue A. Weaver
(74) *Attorney, Agent, or Firm*—Harness, Dickey & Pierce, P.L.C.

(57) ABSTRACT

A hot fill, blow molded plastic container adapted for vacuum pressure absorption having a pair of flex panels and a pair of columns. The flex panels being defined in at least part by a central portion and a perimeter wall portion adjacent to and generally surrounding the central portion. The flex panels being movable to accommodate internal thermally induced volumetric and pressure variations in the container resulting from heating and cooling of its contents.

25 Claims, 5 Drawing Sheets

HOT FILLABLE CONTAINER

TECHNICAL FIELD OF THE INVENTION

This invention generally relates to plastic containers that retain a commodity. More specifically, this invention relates to a hot fillable, blow molded plastic container having a novel construction allowing for significant absorption of vacuum pressures and accommodating reductions in product volume during cooling and capping of a hot filled product while resisting undesirable and unwanted deformation.

BACKGROUND OF THE INVENTION

Traditionally, containers used for the storage of products for human consumption were made of glass. Typical desirable glass characteristics include transparency, indeformability and perfect label fixation. Nevertheless, because glass is fragile, easily breakable and heavy, it has become cost prohibitative, due to the high number of bottle breaks during handling. Moreover, as a result of breakage preventive measures and weight, the transportation expenses associated with glass greatly increases the cost of the product.

Numerous commodities previously supplied in glass containers are now being supplied in plastic containers, more specifically polyester and even more specifically polyethylene terephthalate (PET) containers. Manufacturers and fillers, as well as consumers, have recognized that PET containers are lightweight, inexpensive, recyclable and manufacturable in large quantities.

Manufacturers currently supply PET containers for various liquid commodities, such as beverages. Often these liquid products, such as juices and isotonics, are filled into the containers while the liquid product is at an elevated temperature, typically 68° C.–96° C. (155° F.–205° F.) and usually about 85° C. (185° F.). When packaged in this manner, the hot temperature of the liquid commodity is used to sterilize the container at the time of filling. This process is known as "hot filling". The containers designed to withstand the process are known as "hot fill" or "heat set" containers.

The use of blow molded plastic containers for packaging hot fill beverages is well known. However, a container that is used for hot fill applications is subject to additional mechanical stresses on the container that result in the container being more likely to fail during storage or handling. For example, it has been found that the thin sidewalls of the container deform or collapse as the container is being filled with hot fluids. In addition, the rigidity of the container decreases immediately after the hot fill liquid is introduced into the container. After being hot filled, the heat set containers are capped and allowed to reside at generally about the filling temperature for approximately five (5) minutes. The containers, along with the product, are then actively cooled so that the filled container may be transferred to labeling, packaging and shipping operations. As the liquid cools, it evaporates and shrinks in volume. Thus, upon cooling, the volume of the liquid in the container is reduced. This product shrinkage phenomenon results in the creation of a negative pressure or vacuum within the container. Generally, this negative pressure or vacuum within the container ranges from 1–300 mm Hg less than atmospheric pressure (i.e., 759 mm Hg–460 mm Hg). If not controlled or otherwise accommodated, these negative pressures or vacuums result in deformation of the container which leads to either an aesthetically unacceptable container or one which is unstable. The container must be able to withstand such changes in pressure without failure.

Due to the relative high cost of PET material, even slight increases in the weight of the material of the container will result in an excessive increase in its cost, making it less competitive in relation to the glass bottle, thereby resulting in the infeasibility of such a solution to the problem. Additionally, in many instances, container weight is correlated to the amount of the final vacuum present in the container after this fill, cap and cool down procedure. In order to reduce container weight, i.e., "lightweight" the container, thus providing a significant cost savings from a material standpoint, the amount of the final vacuum must be reduced. Typically, the amount of the final vacuum can be reduced through various processing options such as the use of nitrogen dosing technology, minimize head space or reduce fill temperatures. One drawback with the use of nitrogen dosing technology however is that the maximum line speeds achievable with the current technology is limited to roughly 200 containers per minute. Such slower line speeds are seldom acceptable. Additionally, the dosing consistency is not yet at a technological level to achieve efficient operations. Minimizing head space requires more precision during filling, again resulting in slower line speeds. Reducing fill temperatures limits the type of commodity capable of being used and thus is equally disadvantageous.

The above described negative pressure or vacuum within the container has typically been accommodated by the incorporation of structures in the sidewall of the container. These structures are commonly known as vacuum panels. Traditionally, these paneled areas have been semi-rigid by design, unable to accommodate the high levels of negative pressure or vacuum currently generated, particularly in lightweight containers. Currently, hot fill containers typically include substantially rectangular vacuum panels that are designed to collapse inwardly after the container has been filled with hot product. These rectangular vacuum panels are designed so that as product cools, they will deform and move inwardly. While commercially successful, the inward flexing of the rectangular panels caused by the hot fill vacuum creates high stress points at the top and bottom edges of the pressure panels, especially at the upper and lower corners of the panels. These stress points weaken the portions of the sidewall near the edges of the panels, allowing the sidewall to collapse inwardly during handling of the container or when containers are stacked together.

Thus, there is a need for an improved container which is designed to distort inwardly in a controlled manner under the negative pressure or vacuum which results from hot filling so as to accommodate these negative pressures or vacuum and eliminate undesirable deformation in the container yet which allows for lightweighting, accommodates higher fill temperatures and is capable of being easily handled by an end consumer.

With the forgoing in mind, an object of the present invention is to provide novel hot fillable plastic containers which have vacuum absorption panels that flex during hot filling, capping and cooling; which are resistant to unwanted distortion; and which absorb a majority of the negative pressure or vacuum applied to the container.

It is another object of the present invention to provide a hot filled, blow molded, plastic container which provides improved vacuum panels that minimize the stress points on the corners of the vacuum panels, by substantially removing these stress points, and thereby provide lower failure rates.

In function of the above mentioned qualities, associated with its transparency, the proposed container is an extremely inexpensive and efficient means for the container user to promote its product, thus contributing to reinforce the good image of its company in the market. It is therefore an object of this invention to provide such a container.

SUMMARY OF THE INVENTION

Accordingly, this invention provides for a plastic container which maintains aesthetic and mechanical integrity during any subsequent handling after being hot filled and cooled to ambient having a structure that is designed to distort inwardly in a controlled manner so as to allow for significant absorption of negative pressure or vacuum within the container without unwanted deformation.

In achieving the above and other objects, the present invention includes a hot fillable, blow molded plastic container having an upper portion, a sidewall portion and a base. The upper portion includes an opening defining a mouth of the container. The sidewall portion extends from the upper portion to the base. The sidewall portion includes flex panels and columns. The flex panels being moveable to accommodate vacuum forces generated within the container thereby decreasing the volume of the container.

Additional benefits and advantages of the present invention will become apparent to those skilled in the art to which the present invention relates from the subsequent description of the preferred embodiment and the appended claims, taken in conjunction with the accompanying drawings.

DETAILED DESCRIPTION OF THE PREFERRED EMBODIMENT

Figure 1:
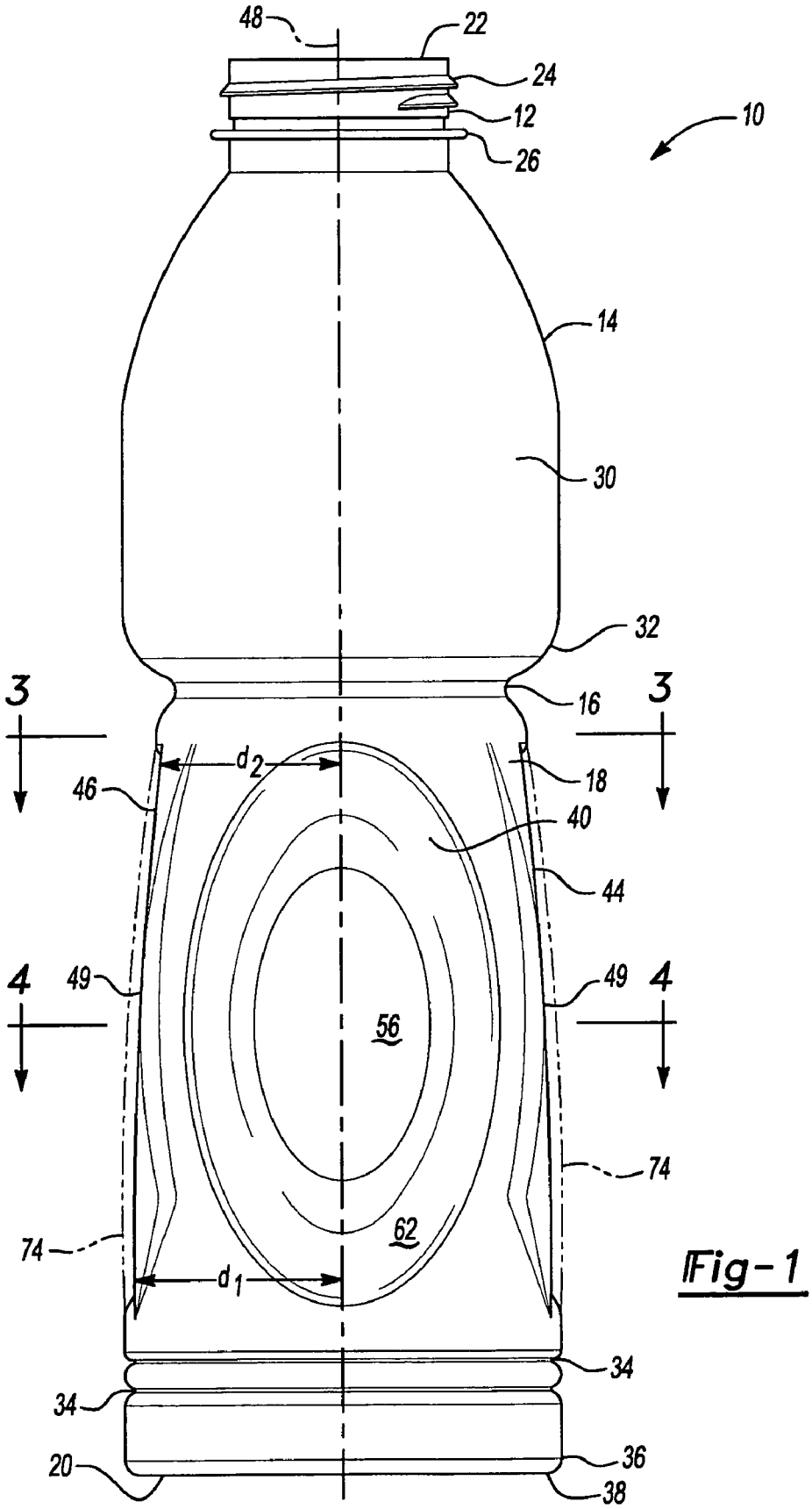
FIG. 1 is a side elevational view of a container embodying the principles of the present invention.

The following description of the preferred embodiment is merely exemplary in nature, and is in no way intended to limit the invention or its application or uses.

As discussed above, to accommodate vacuum forces during cooling of the contents within a hot fill or heat set container, containers have been provided with a series of vacuum panels around their sidewalls. Traditionally, these vacuum panels have been semi-rigid and incapable of preventing unwanted distortion elsewhere in the container, particularly in lightweight containers.

Referring now to the drawings, there is depicted a hot fillable, blow molded plastic container 10 embodying the principles and concepts of the present invention. The container 10 of the present invention illustrated in FIGS. 1–6 is particularly suited for hot fill packaging of product, typically a liquid or beverage, while the product is in a heated state. The container 10 can be filled by automated, high speed, hot fill equipment known in the art. After filling, the container 10 is sealed and cooled. The unique construction of the container 10 enables it to accommodate vacuum-induced volumetric shrinkage caused by hot filling while affording a consumer-friendly package that is easy to grip with one hand. While designed for use in hot fill applications, it is noted that the container 10 is also acceptable for use in non-hot fill applications. The teachings of the present invention are more broadly applicable to a large range of plastic containers.

The disclosed container structures can be made by stretch blow molding from an injection molded preform of any of several well known plastic materials. Accordingly, the plastic container 10 of the present invention is a blow molded, biaxially oriented container with an unitary construction from a single or multi-layer material such as polyethylene terephthalate (PET) resin. Alternatively, the plastic container 10 may be formed by other methods and from other conventional materials including, for example, polyethylene napthalate (PEN), and a PET/PEN blend or copolymer. Such materials have proven particularly suitable for applications involving hot fill processing wherein contents are heated to temperatures greater than 85° C. (185° F.) before the container is capped and allowed to cool to ambient temperature. Plastic containers blow molded with an unitary construction from PET materials are known and used in the art of plastic containers, and their general manufacture in the present invention will be readily understood by a person of ordinary skill in the art.

As illustrated in the figures, the plastic container 10 of the present invention generally includes a finish 12, a shoulder region 14, a waist segment 16, a sidewall portion 18 and a base 20.

The finish 12 of the plastic container 10 includes a portion defining an aperture or mouth 22, a threaded region 24 and a support ring 26. The aperture 22 allows the plastic container 10 to receive a commodity while the threaded region 24 provides a means for attachment of a similarly threaded closure or cap 28, shown in FIG. 5. Alternatives may include other suitable devices which engage the finish 12 of the plastic container 10. Accordingly, the closure or cap 28 functions to engage with the finish 12 so as to preferably provide a hermetical seal for the plastic container 10. The closure or cap 28 is preferably made from a plastic or metal material conventional to the closure industry. The support ring 26 may be used to carry or orient the preform (the precursor to the plastic container 10) (not shown) through and at various stages of manufacture. For example, the preform may be carried by the support ring 26, the support ring 26 may be used to aid in positioning the preform in the mold, or the support ring 26 may be used by an end consumer to carry the plastic container 10.

Integrally formed with the finish 12 and extending downward therefrom is the shoulder region 14. The shoulder region 14 is circular in traverse cross-section adjacent to the sidewall portion 18 and defines a maximum diameter of the container 10 at this point. The shoulder region 14 includes a label mounting area 30. A label can be applied to the label mounting area 30 using methods that are well known to those skilled in the art, including shrink wrap labeling and adhesive methods. As applied, the label can extend around the entire body of the shoulder region 14. While a preferred shoulder region 14 is illustrated in the drawings, other shoulder region configurations can be utilized with the novel features of the present invention.

The shoulder region 14 merges into the waist segment 16. The waist segment 16 extends sharply inwardly below a label bumper 32 at the lower portion of the shoulder region 14. The waist segment 16 severely pinches inward below the label bumper 32 in order to prevent ovalization of the label mounting area 30 of the shoulder region 14. The waist segment 16 provides a transition between the shoulder region 14 and the sidewall portion 18. The sidewall portion 18 extends downward from the waist segment 16 to the base 20. Because of the specific construction of the sidewall portion 18, a significantly lightweight container can be formed. Such a container 10 can exhibit at least a ten percent (10%) reduction in weight from those of current stock containers and are extremely capable of accommodating high fill temperatures.

The base 20 of the plastic container 10, which extends inward from the sidewall portion 18, generally includes concentric rings 34, a chime 36 and a contact ring 38. The base 20 is coaxial with the shoulder region 14, and similar to the shoulder region 14, is circular in transverse cross-section adjacent to the sidewall portion 18 and defines a maximum diameter of the container 10 at this point. The concentric rings 34 isolate the base 20 from any sidewall portion 18 movement and create structure, thus aiding the base 20 in maintaining its roundness after the container 10 is filled, sealed and cooled, increasing stability of the container 10, and minimizing rocking as the container 10 shrinks after initial removal from its mold. The contact ring 38 is itself that portion of the base 20 which contacts a support surface upon which the container 10 is supported. As such, the contact ring 38 may be a flat surface or a line of contact generally circumscribing, continuously or intermittently, the base 20. The base 20 functions to close off the bottom portion of the plastic container 10 and, together with the shoulder region 14, the waist segment 16 and the sidewall portion 18, to retain the commodity. While a preferred base 20 is illustrated in the drawings, other base configurations can be utilized with the novel features of the present invention.

Figure 3:
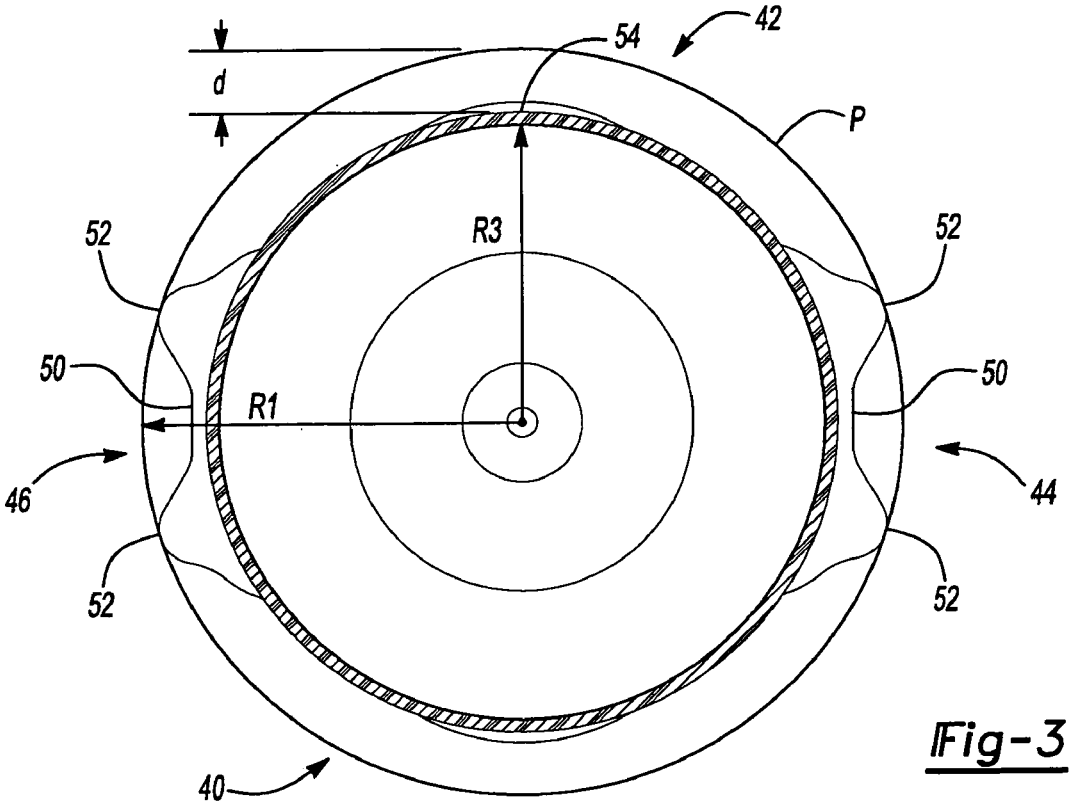
FIG. 3 is a cross-sectional view of the container, taken generally along the line 3—3 of FIG. 1, the container as molded and empty.

The plastic container 10 is preferably heat set according to the above mentioned process or other conventional heat set processes. To accommodate the negative pressure or vacuum forces within the container 10, the sidewall portion 18 of the present invention adopts a novel and innovative construction. To this end, the sidewall portion 18 includes an arcuate first flex panel 40 located opposite an arcuate second flex panel 42. Accordingly, the first flex panel 40 and the second flex panel 42 are located diametrically opposite one another and, if desired, can be mirror images of one another. The first and second flex panels 40 and 42 are separated and interconnected by a pair of columns 44 and 46. The columns 44 and 46 are similarly located diametrically opposite one another and, if desired, can be mirror images of one another. The flex panels 40 and 42, and the columns 44 and 46 extend vertically between the waist segment 16 and the base 20 of the container 10. Together, the flex panels 40 and 42, and the columns 44 and 46 form a continuous integral circumferential sidewall portion 18. The flex panels 40 and 42, and the columns 44 and 46, have generally similar radii of curvature and are relatively concentric to one another. Accordingly, the sidewall portion 18 appears to be substantially circular in transverse cross-section at its upper and lower portions. As illustrated in FIG. 3, a cylindrical plane "P" passes through the columns 44 and 46, while the flex panels 40 and 42 are inset from that plane.

Figure 2:
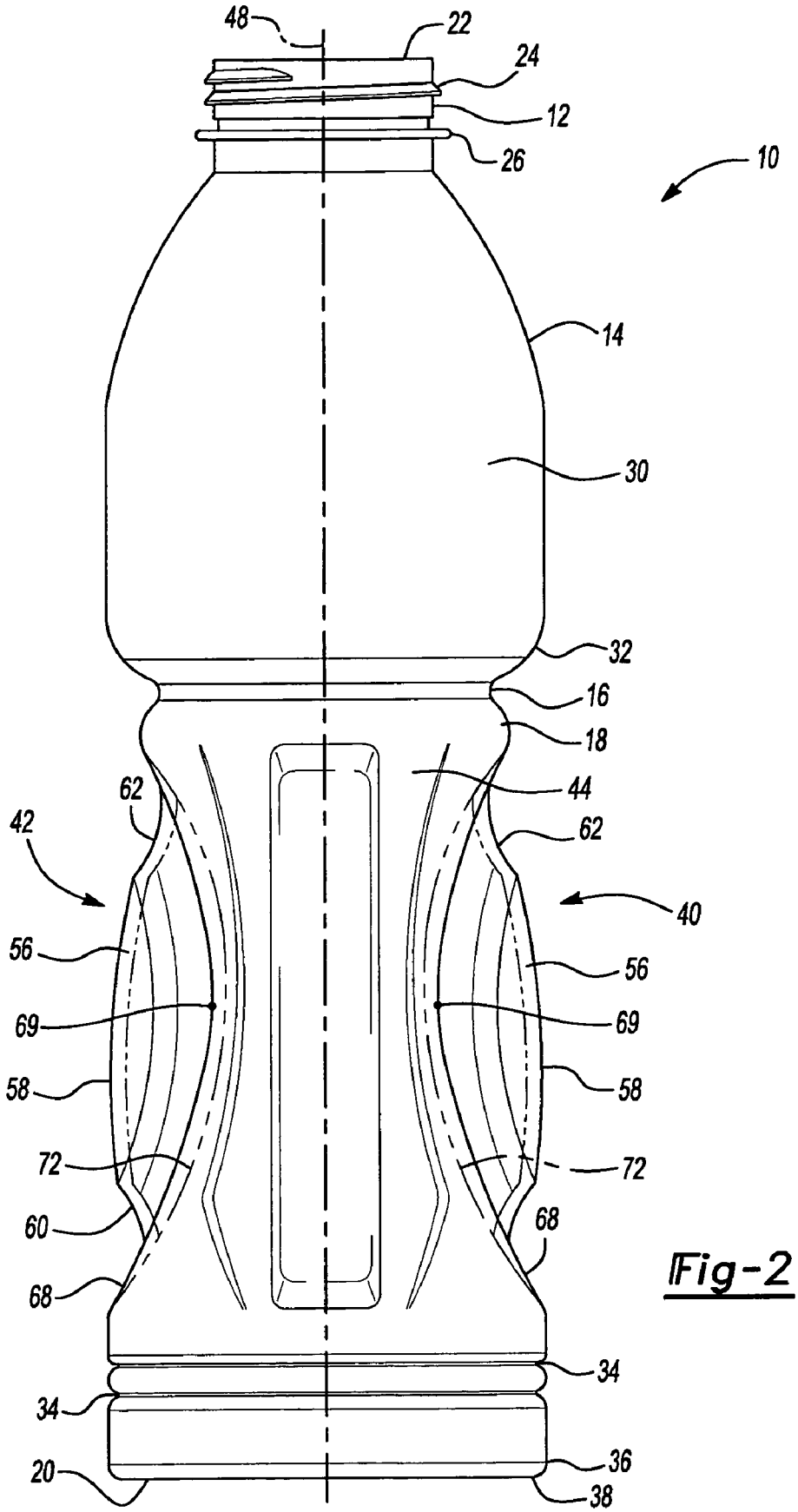
FIG. 2 is a front elevational view of the container illustrated in FIG. 1.
Figure 4:
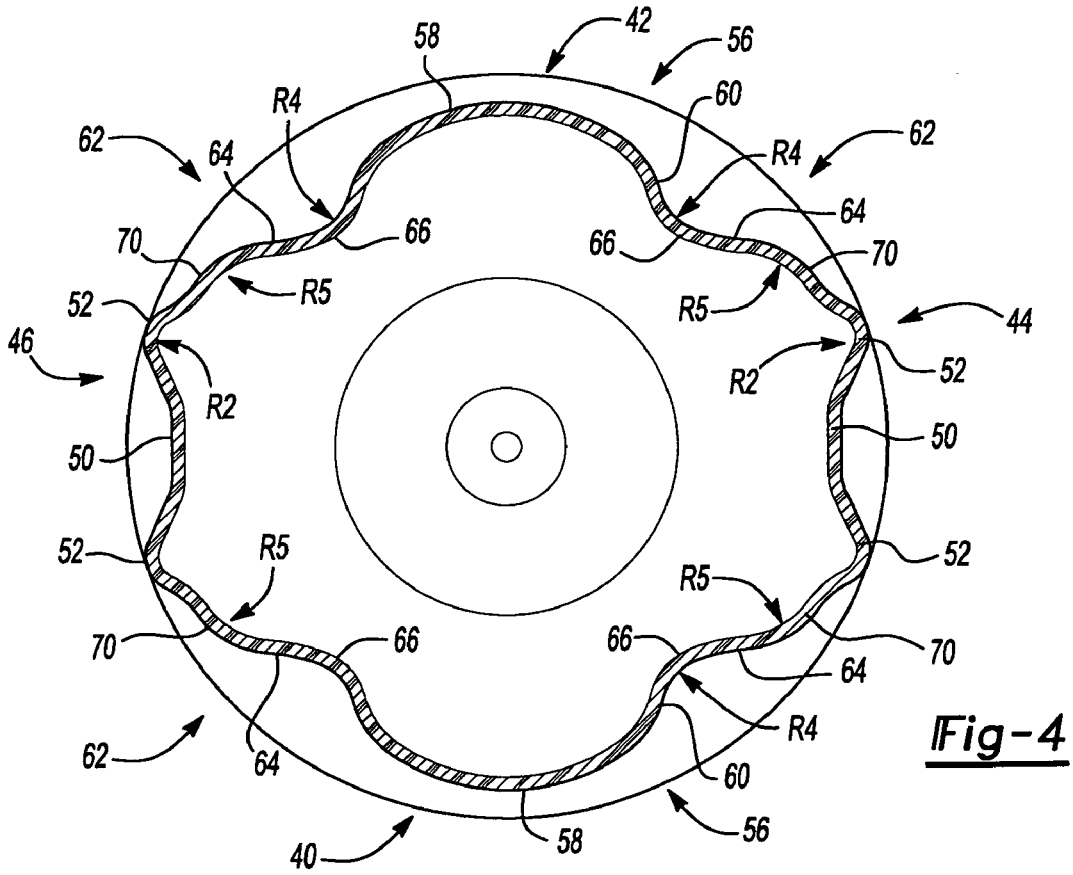
FIG. 4 is a cross-sectional view of the container, taken generally along the line 4—4 of FIG. 1, the container as molded and empty.
Figure 5:
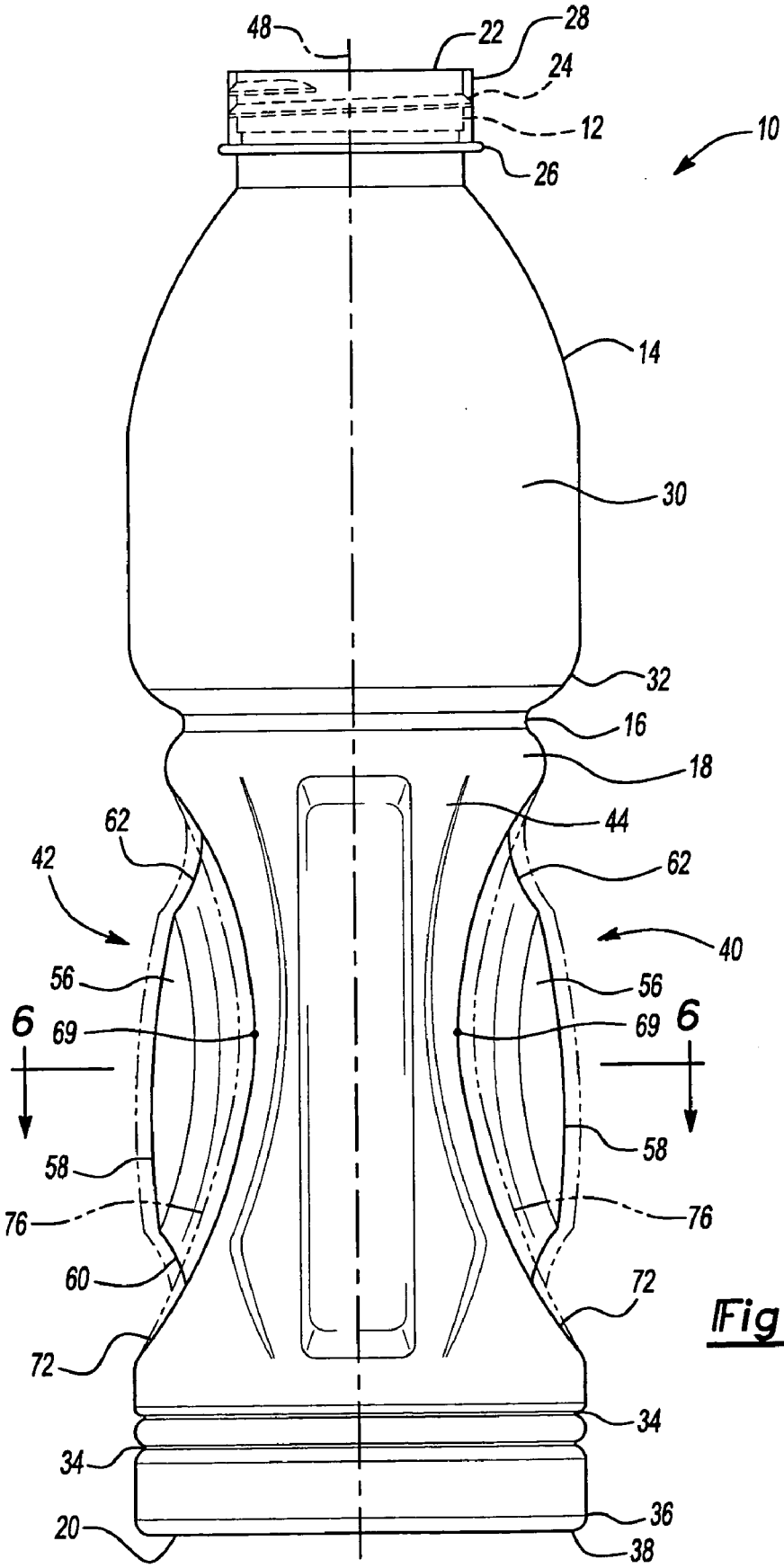
FIG. 5 is a front elevational view of the container illustrated in FIG. 1, the container being filled and sealed.
Figure 6:
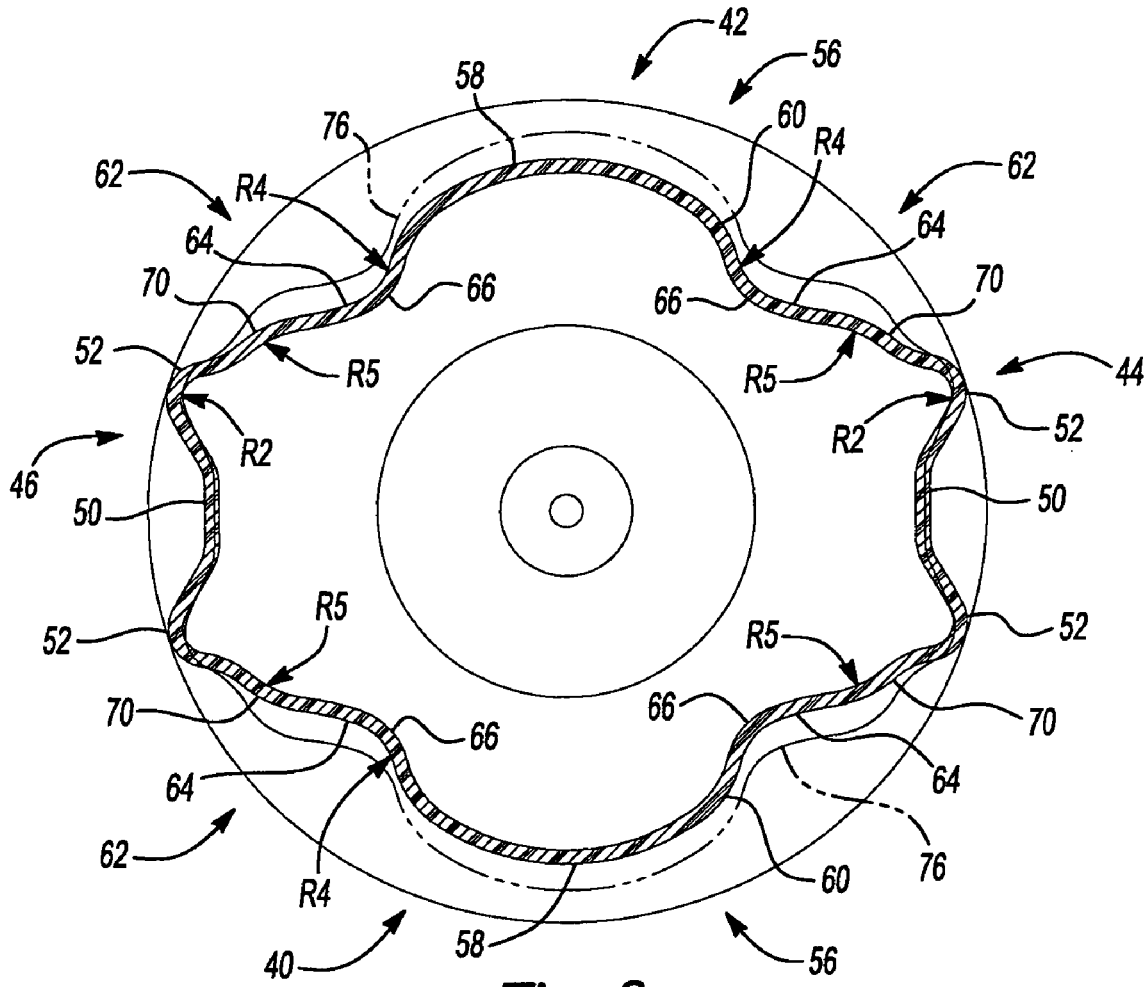
FIG. 6 is a cross-sectional view of the container, taken generally along the line 6—6 of FIG. 5, the container being filled and sealed.

As illustrated in FIGS. 2 and 5, the columns 44 and 46 extend continuously in a longitudinal direction from the waist segment 16 to the base 20. As illustrated in FIG. 3, each column 44 and 46 have a similar predetermined radius of curvature $R_1$, throughout its arcuate extent. The columns 44 and 46 include a unique I-beam construction which adds structure, support and strength to the sidewall portion 18 of the container 10. This added structure and support, resulting from the I-beam construction of the columns 44 and 46, minimizes the outward movement or bowing of the columns 44 and 46 during the fill, seal and cool down procedure. Accordingly, contrary to the flex panels 40 and 42, the columns 44 and 46 maintain their relative stiffness throughout the fill, seal and cool down procedure. The columns 44 and 46 provide a generally outward arcuate first convex shaped surface 49 as formed with a distance $d_1$ from a central longitudinal axis 48 of the container 10 toward the base 20 of the container 10, being greater than a distance $d_2$ from the central longitudinal axis 48 of the container 10 toward the waist segment 16 of the container 10. As illustrated in FIGS. 4 and 6, columns 44 and 46 include a generally concave lower surface 50. Lower surface 50 is surrounded by and merges with outer ribbed surfaces 52 having a radius of curvature $R_2$. In accordance with this unique I-beam construction, the ribbed surfaces 52 are the flat, flange portions of the I-beam while the lower surface 50 is the web portion between the flange portions. It should be noted that the ribbed surface 52 is a distinctly identifiable structure helping to distinguish between columns 44 and 46, and flex panels 40 and 42. The ribbed surfaces 52 provide strength to the transition between columns 44 and 46, and flex panels 40 and 42. This transition must be abrupt in order to maximize the local strength as well as to form a geometrically rigid structure. The resulting localized strength increases the resistance to creasing in the sidewall portion 18.

Flex panels 40 and 42 extend vertically from the waist segment 16 to the base 20. As illustrated in FIG. 3, flex panels 40 and 42 have a similar predetermined radius of curvature $R_3$, throughout their arcuate extent. The radius of curvature $R_3$ of each flex panel 40 and 42 is generally similar to the radius of curvature $R_1$ of columns 44 and 46. Thus, in transverse cross-section, the sidewall portion 18, at its upper and lower portions, appears to be substantially circular in shape. This relationship is illustrated by the circular plane designated as "P", in FIG. 3 and the distance "d" which represents the distance a vertical medial apogee 54 of the flex panel 42 is inset from the cylindrical plane "P" passing through columns 44 and 46.

Formed substantially vertically centered on each flex panel 40 and 42 is a floating island 56. The floating island 56 is generally elliptical in shape, and includes a top, outer wall surface 58 and a downwardly extending wall surface 60. Also formed in flex panels 40 and 42, adjacent to and generally surrounding the floating island 56, is a perimeter wall portion or moat 62. Perimeter wall portion or moat 62 includes a lower wall surface 64. Downwardly extending wall surface 60 of the floating island 56 and lower wall surface 64 are connected by an inwardly concave wall portion 66 having a radius of curvature $R_4$. Accordingly, the perimeter wall portion or moat 62, surrounding the floating island 56, is similarly elliptical in shape.

As illustrated in FIG. 2, the first and second flex panels 40 and 42, without consideration of the floating islands 56, exhibit a generally inward arcuate first concave shaped surface 68 extending downward from the waist segment 16 to the base 20. This arcuate, concave shaped surface can also be described as defining a hourglass silhouette. As illustrated in FIGS. 2 and 5, the two flex panels 40 and 42 cooperate to define a minimum diameter for the container 10 generally about each of their longitudinal midpoints 69.

Additionally, the floating islands 56 cooperate with the perimeter wall portion or moat 62 to form a gripping surface such that a person handling the container 10 can easily grasp the container 10 between his/her thumb and fingers of one hand. Thereby providing and affording a consumer-friendly container 10 that is easy to grip with one hand.

A zone of transition provides a smooth and continuous transition of the container wall between flex panels 40 and 42, and columns 44 and 46. As illustrated in FIGS. 4 and 6, this zone of transition is defined by a wall portion 70 having a radius of curvature $R_5$. Accordingly, the wall portion 70 connects and merges the lower wall surface 64 of the perimeter wall portion or moat 62 of flex panels 40 and 42 with the ribbed surface 52 of columns 44 and 46.

The different arcuate sections of the sidewall portion 18 provide different functions. For instance, in response to hot filling, the arcuate columns 44 and 46 resist deformation, while the arcuate flex panels 40 and 42 move radially inward to accommodate volumetric shrinkage of the container 10. In order to properly achieve these functions, the wall thickness of flex panels 40 and 42 must be thin enough to allow flex panels 40 and 42 to be flexible. Typically, the wall thickness of flex panels 40 and 42 is approximately between about 0.012 inch (0.305 mm) to about 0.017 inch (0.432 mm), while the wall thickness of columns 44 and 46 is approximately between about 0.009 inch (0.229 mm) to about 0.017 inch (0.432 mm).

Upon filling with a hot product, capping, sealing and cooling, as illustrated in FIGS. 5 and 6, the floating island 56 and the perimeter wall portion or moat 62 of flex panels 40 and 42 are controllably pulled radially inward, toward the central longitudinal axis 48 of the container 10, displacing volume, as a result of vacuum forces. At this time, flex panels 40 and 42, without consideration of the floating islands 56, form a generally inward arcuate second concave shaped surface 72, as illustrated in phantom line in FIG. 2, and as further shown in FIG. 5. The overall large dimension of flex panels 40 and 42, approximately two-thirds (⅔) of the angular or circumferential extent of the container 10, facilitates the ability of flex panels 40 and 42 to accommodate a significant amount of negative pressure or vacuum. Flex panels 40 and 42 are configured such that they absorb at least sixty-nine percent (69%) of the negative pressure or vacuum, and preferably at least eighty-six percent (86%), and most preferably about ninety-four percent (94%) upon cooling. In other terms, flex panels 40 and 42 move radially inward in response to a vacuum related force created after filling, sealing and cooling container 10, so as to accommodate and alleviate a majority of that force.

Upon filling with a hot product, capping, sealing and cooling, as flex panels 40 and 42 are controllable pulled radially inward, toward the central longitudinal axis 48 of the container 10, the more rigid columns 44 and 46 slightly expand radially outwardly, away from the central longitudinal axis 48 of the container 10 providing a generally outward arcuate second convex shaped surface 74, as illustrated in phantom line in FIG. 1.

The interrelationship between flex panels 40 and 42, and columns 44 and 46 during this negative pressure or vacuum absorption phenomenon is further illustrated in comparing. FIG. 4 with FIG. 6. In comparing FIG. 4 with FIG. 6, it is recognized and illustrated that upon filling with a hot product, capping, sealing and cooling, the radii of curvature associated with flex panels 40 and 42, $R_4$ and $R_5$, are greater (shown in FIG. 6) than those same radii of curvature associated with flex panels 40 and 42 of the container 10 as originally blown (shown in FIG. 4). Conversely, upon filling with a hot product, capping, sealing and cooling, the radius of curvature associated with columns 44 and 46, $R_2$, is lesser (shown in FIG. 6) than the same radius of curvature associated with columns 44 and 46 of the container 10 as originally blown (shown in FIG. 4). This interrelationship is further illustrated in FIG. 5 and FIG. 6 wherein phantom line 76 shows the container 10 as originally blown (as shown in FIG. 2 and FIG. 4). This phenomenon maximizes the local strength and forms a geometrically rigid structure. The resulting localized strength increases the resistance to creasing in the sidewall portion 18 of the container 10.

The novel shape of the container 10 further lends itself to lightweighting. As compared to containers of similar volumetric sizes and types, the container 10 generally realizes at least a ten percent (10%) reduction in weight and as much as a forty percent (40%) reduction in weight.

As formed, flex panels 40 and 42 are generally concave and move radially inward toward a somewhat more concave shape in response to vacuum-induced volumetric shrinkage of the hot filled container 10, which can be described as defining a second, more hourglass silhouette. Compare first concave shaped surface 68 with second concave shaped surface 72 in FIG. 2 and first concave shaped surface, designated as phantom line 76, with second concave shaped surface 72 in FIG. 5. Thus, flex panels 40 and 42 accommodate a significant portion of the volumetric shrinkage without distorting the sidewall portion 18 of the container 10 by inverting or denting. The greater the inward radial movement of flex panels 40 and 42, the greater the achievable displacement of volume. Deformation of the sidewall portion 18 of the container 10 is avoided by controlling and limiting the deformation to flex panels 40 and 42. Accordingly, the thin, flexible, generally compound curve geometry of flex panels 40 and 42 of the sidewall portion 18 of the container 10 allows for greater volume displacement versus containers having a semi-rigid sidewall portion.

While the above description constitutes the preferred embodiment of the present invention, it will be appreciated that the invention is susceptible to modification, variation and change without departing from the proper scope and fair meaning of the accompanying claims.

What is claimed is:

1. A blow molded, biaxially oriented plastic container adapted for vacuum absorption, the container having an upper portion including a mouth defining an opening into the container, a shoulder portion forming a label surface and a pinched waist portion, a lower portion forming a base, a sidewall portion connected with and extending between said upper portion and said lower portion, and a central longitudinal axis; said upper portion, said lower portion and said sidewall portion cooperating to define a receptacle chamber within the container into which product can be filled; said sidewall portion including a pair of diametrically opposed flex panels and a pair of diametrically opposed columns, said columns being a first distance from said central longitudinal axis adjacent said lower portion and a second distance from said central longitudinal axis adjacent said upper portion, said first distance being greater than said second distance, said flex panels defined in at least part by a central portion and a perimeter wall portion adjacent to and generally surrounding said central portion, said flex panels being movable to accommodate internal changes in pressure and volume in the container resulting from heating and cooling of its contents.

2. The container according to claim 1 wherein said lower portion includes at least one concentric ring.

3. The container according to claim 1 wherein said central portion of said flex panels includes a floating island, and said perimeter wall portion and said floating island are generally elliptical in shape.

4. The container according to claim 1 wherein said central portion and said perimeter wall portion of said flex panels combine to form a compound curve.

5. The container according to claim 1 wherein said flex panels form a first generally concave shaped surface in cross section and said columns form a first generally convex shaped surface in cross section when the container is formed.

6. The container according to claim 5 wherein said flex panels form a second generally concave shaped surface in cross section and said columns form a second generally convex shaped surface in cross section when the container is filled, sealed and cooled.

7. The container according to claim 1 wherein said flex panels form a hand grip surface.

8. A blow molded plastic container adapted for vacuum absorption, the container having an upper portion including a mouth defining an opening into the container, a shoulder portion forming a label surface and a pinched waist portion, a lower portion forming a base, a sidewall portion connected with and extending between said upper portion and said lower portion, and a central longitudinal axis; said upper portion, said lower portion and said sidewall portion cooperating to define a receptacle chamber within the container into which product can be filled; said sidewall portion including a pair of diametrically opposed flex panels and a pair of diametrically opposed columns formed therein, said flex panels having a central portion and a perimeter wall portion adjacent to and generally surrounding said central portion, said flex panels forming a first generally concave shaped surface in cross section and said columns forming a first generally convex shaped surface in cross section, said columns being a first distance from said central longitudinal axis adjacent said lower portion and a second distance from said central longitudinal axis adjacent said upper portion, said first distance being greater than said second distance, said flex panels being movable to accommodate vacuum forces generated within the container thereby decreasing the volume of the container.

9. The container according to claim 8 wherein said flex panels form a second generally concave shaped surface in cross section and said columns form a second generally convex shaped surface in cross section when the container is filled, sealed and cooled.

10. The container according to claim 8 wherein said lower portion includes two concentric rings.

11. The container according to claim 8 wherein said central portion of said flex panels includes a floating island, and said floating island and said perimeter portion are generally elliptical in shape.

12. The container according to claim 8 wherein said flex panels form a hand grip surface.

13. The container according to claim 8 wherein said upper portion defines a generally circular cross section immediately adjacent to said sidewall portion and said lower portion defines a generally circular cross section immediately adjacent to said sidewall portion.

14. The container according to claim 13 wherein said upper portion immediately adjacent to said sidewall portion and said lower portion immediately adjacent to said sidewall portion define a maximum diameter of the container.

15. A blow molded plastic container comprising:

an upper portion defining a mouth;

a shoulder portion forming a label surface and having a pinched waist portion formed with said upper portion and extending downward therefrom;

a lower portion forming a base of the container;

a central longitudinal axis; and a sidewall extending between and joining said shoulder portion with said lower portion, said sidewall including a pair of diametrically opposed flex panels, said flex panels having a central floating island portion and a perimeter wall portion adjacent to and generally surrounding said island portion, said flex panels being inwardly movable along a radial axis, said movement being in response to internal changes in pressure and volume in the container resulting from heating and cooling of its contents, and a pair of diametrically opposed columns, said columns being a first distance from said central longitudinal axis adjacent said lower portion and a second distance from said central longitudinal axis adjacent said shoulder portion, said first distance being greater than said second distance.

16. The container according to claim 15 wherein said flex panels form a first generally concave shaped surface in cross section and said columns form a first generally convex shaped surface in cross section when the container is formed.

17. The container according to claim 16 wherein said flex panels form a second generally concave shaped surface in cross section and said columns form a second generally convex shaped surface in cross section when the container is filled, sealed and cooled.

18. The container according to claim 15 wherein said central floating island portion and said perimeter wall portion are generally elliptical in shape.

19. The container according to claim 15 wherein said pinched waist portion is located immediately adjacent said sidewall and said lower portion includes at least one concentric ring immediately adjacent said sidewall.

20. The container according to claim 15 wherein said flex panels form a hand grip surface.

21. The container according to claim 15 wherein said shoulder portion defines a generally circular cross section immediately adjacent to said sidewall and said lower portion defines a generally circular cross section immediately adjacent to said sidewall.

22. The container according to claim 21 wherein said shoulder portion immediately adjacent to said sidewall and said lower portion immediately adjacent to said sidewall define a maximum diameter of the container.

23. A blow molded, biaxially oriented plastic container adapted for vacuum absorption, the container having an upper portion including a mouth defining an opening into the container, a lower portion forming a base, a sidewall portion connected with and extending between said upper portion and said lower portion, and a central longitudinal axis; said upper portion, said lower portion and said sidewall portion cooperating to define a receptacle chamber within the container into which product can be filled; said sidewall portion including a pair of diametrically opposed flex panels and a pair of diametrically opposed columns, said columns being a first distance from said central longitudinal axis adjacent said lower portion and a second distance from said central longitudinal axis adjacent said upper portion, said first distance being greater than said second distance, said flex panels defined in at least part by a central portion, a perimeter wall portion adjacent to and generally surrounding said central portion, and a longitudinal midpoint, said flex panels further defining a minimum diameter for the container generally about said longitudinal midpoint, said flex panels being movable to accommodate internal changes in pressure and volume in the container resulting from heating and cooling of its contents.

24. A blow molded plastic container adapted for vacuum absorption, the container having an upper portion including a mouth defining an opening into the container, a lower portion forming a base, a sidewall portion connected with and extending between said upper portion and said lower portion, and a central longitudinal axis; said upper portion, said lower portion and said sidewall portion cooperating to define a receptacle chamber within the container into which product can be filled; said sidewall portion including a pair of diametrically opposed flex panels and a pair of diametrically opposed columns formed therein, said flex panels having a central portion, a perimeter wall portion adjacent to and generally surrounding said central portion, and a longitudinal midpoint, said flex panels defining a minimum diameter for the container generally about said longitudinal midpoint, said flex panels forming a first generally concave shaped surface in cross section and said columns forming a first generally convex shaped surface in cross section, said columns being a first distance from said central longitudinal axis adjacent said lower portion and a second distance from said central longitudinal axis adjacent said upper portion, said first distance being greater than said second distance, said flex panels being movable to accommodate vacuum forces generated within the container thereby decreasing the volume of the container.

25. A blow molded plastic container comprising:

an upper portion defining a mouth;

a shoulder portion formed with said upper portion and extending downward therefrom;

a lower portion forming a base of the container;

a central longitudinal axis; and a sidewall extending between and joining said shoulder portion with said lower portion, said sidewall including a pair of diametrically opposed flex panels, said flex panels having a central floating island portion, a perimeter wall portion adjacent to and generally surrounding said island portion, and a longitudinal midpoint, said flex panels defining a minimum diameter for the container generally about said longitudinal midpoint, said flex panels being inwardly movable along a radial axis, said movement being in response to internal changes in pressure and volume in the container resulting from heating and cooling of its contents, and a pair of diametrically opposed columns, said columns being a first distance from said central longitudinal axis adjacent said lower portion and a second distance from said central longitudinal axis adjacent said shoulder portion, said first distance being greater than said second distance.

* * * * *